US007370775B2

(12) United States Patent
Noll et al.

(10) Patent No.: US 7,370,775 B2
(45) Date of Patent: May 13, 2008

(54) PRESSURE BASE FOR PLASTIC CONTAINER

(75) Inventors: Angie Noll, York, PA (US); Nicole Korpanty, York, PA (US); Luis Carvallo, Owings Mills, MD (US)

(73) Assignee: Graham Packaging Company, L.P., York, PA (US)

( * ) Notice: Subject to any disclaimer, the term of this patent is extended or adjusted under 35 U.S.C. 154(b) by 377 days.

(21) Appl. No.: 10/740,761

(22) Filed: Dec. 22, 2003

(65) Prior Publication Data

US 2005/0133513 A1 Jun. 23, 2005

(51) Int. Cl.
*B65D 25/54* (2006.01)
*B65D 8/04* (2006.01)
*B65D 90/02* (2006.01)

(52) U.S. Cl. ..... 220/623; 220/606; 215/371

(58) Field of Classification Search ..... 220/623, 220/606, 613; 215/371
See application file for complete search history.

(56) References Cited

U.S. PATENT DOCUMENTS

| | | | | |
|---|---|---|---|---|
| 3,720,339 | A | 3/1973 | Khetani | |
| 3,942,673 | A | 3/1976 | Lyu et al. | |
| 4,412,627 | A | 11/1983 | Houghton et al. | |
| 4,502,607 | A * | 3/1985 | Szajna | 220/608 |
| 4,515,284 | A | 5/1985 | Lee, Jr. et al. | |
| 4,598,831 | A * | 7/1986 | Nakamura et al. | 215/373 |
| 4,840,289 | A * | 6/1989 | Fait et al. | 220/270 |
| 4,880,129 | A | 11/1989 | McHenry et al. | |
| 5,217,737 | A | 6/1993 | Gygax et al. | |
| 5,234,126 | A | 8/1993 | Jonas et al. | |
| 5,469,984 | A | 11/1995 | Kalkanis | |
| 5,492,245 | A | 2/1996 | Kalkanis | |
| 5,603,423 | A | 2/1997 | Lynn et al. | |
| 6,299,007 | B1 | 10/2001 | Takeuchi | |
| 6,378,723 | B1 * | 4/2002 | Casey | 220/608 |
| 6,637,612 | B2 * | 10/2003 | Maczek | 215/373 |
| 2002/0074336 | A1 * | 6/2002 | Silvers | 220/623 |
| 2003/0052076 | A1 | 3/2003 | Cheng et al. | |
| 2003/0178386 | A1 | 9/2003 | Maczek | |

FOREIGN PATENT DOCUMENTS

| | | |
|---|---|---|
| DE | 1941979 | 7/1966 |
| EP | 0865898 | 9/1998 |
| LU | 77042 | 11/1978 |

* cited by examiner

*Primary Examiner*—Anthony D. Stashick
*Assistant Examiner*—Shawn M. Braden
(74) *Attorney, Agent, or Firm*—Knoble Yoshida & Dunleavy, LLC

(57) ABSTRACT

A base for a container is provided. The base includes an annular bearing surface that defines a bearing plane. The base also includes a parting line that extends along the base and defines first and second portions on opposite sides of the parting line. The base further includes an inner portion that is spaced from the bearing plane and surrounded by the annular bearing surface. In such a base, the first portion is offset from the second portion.

22 Claims, 5 Drawing Sheets

PRESSURE BASE FOR PLASTIC CONTAINER

BACKGROUND OF THE INVENTION

1. Field of the Invention

The present invention relates generally to a container base for enhancing the structural integrity of the base.

2. Related Art

Plastic containers, such as polyolefin containers, can be used for packaging salty snack dry food. It is understood by a person having ordinary skill in the art that to form such polyolefin containers, a parison can be heated in an extruder, captured by a mold, and blown in the mold. Specifically, to form the cavity of the container, a parison can be extruded up into the mold and as the mold comes together, a pneumatic blow pin, for example, can pierce the parison and blow the parison up against the walls of the mold. The mold typically contains flash pockets above and below the cavity in the mold to capture the excess parison above and below the cavity. It can be understood by a person having ordinary skill in the art, that as the parison is blown inside the mold and captured in the flash pockets, portions of the parison must adhere together. Once the container is cooled, the excess flash can then be cut away from the container after being ejected from the mold.

Salty snack dry food containers can be filled at altitudes at or below sea level and then fitted with an airtight seal. When these containers are subsequently shipped, they must be able resist deformation caused by changes in external air pressure that can cause changes in the internal pressure of the container. For example, when the containers are shipped at high altitudes, e.g., across mountains, the external pressure can drop such that the containers have an effective internal pressure of up to 8 psi.

Such an increase in effective internal pressure can cause the bases of the containers to distort. Often times, an inner portion of the base will distort below the intended bearing surface of the base. When such distortion occurs, the container tends to rock on the inner portion of the base instead of standing upright on the bearing surface of the base.

What is needed, then, is a plastic container having a base design that is capable of withstanding changes in pressure without distortion below the bearing surface of the base.

BRIEF SUMMARY OF THE INVENTION

In an exemplary embodiment of the invention, a base for a container is provided. The base includes an annular bearing surface that defines a bearing plane. The base also includes a parting line that extends along the base and defines first and second portions on opposite sides of the parting line. The base further includes an inner portion that is spaced from the bearing plane and surrounded by the annular bearing surface. In such a base, the first portion and the second portion together form an offset that is resistant to an increase in internal pressure.

In a further embodiment of the invention, a container base is provided. The base includes an annular bearing portion that has a width and defines a bearing surface and a bearing plane. The base also has an inner portion having a diameter and being spaced from the bearing plane and surrounded by the annular bearing surface. In such a base, the diameter of the inner portion is between 20 and 40 times the width of the annular bearing.

In yet a further embodiment of the invention, a method of packaging a product is provided. The method includes the steps of providing a container having a base according to the present invention, placing the product into the container, and providing an air tight seal over a mouth of the container.

In still a further embodiment of the invention, a container base is provided. The base includes an annular bearing surface defining a bearing plane, a linear parting line extending along the base defining first and second portions on opposite sides of the parting line, and an inner portion spaced from the bearing plane and surrounded by the annular bearing surface. In such a base, the first portion is and the second portion together form an offset that provides resistance to distortion upon an increase of internal pressure within the container.

In another embodiment of the invention, a blow-molded plastic container base is provided. The base includes an annular bearing surface defining a bearing plane, a parting line formed along the junctions of mold halves during blow-molding for extending along the base and defining first and second portions on opposite sides of the parting line, and an inner portion spaced from the bearing plane and surrounded by the annular bearing surface. The first portion and the second portion together form an offset.

In yet another embodiment of the invention, a container base is provided. The container base includes an annular bearing surface defining a bearing plane, a parting line extending along the base defining substantially flat first and second portions on opposite sides of the parting line, and an inner portion spaced from the bearing plane and surrounded by the annular bearing surface The first portion and the second portion together form an offset.

Further objectives and advantages, as well as the structure and function of preferred embodiments will become apparent from a consideration of the description, drawings, and examples.

BRIEF DESCRIPTION OF THE DRAWINGS

The foregoing and other features and advantages of the invention will be apparent from the following, more particular description of a preferred embodiment of the invention, as illustrated in the accompanying drawings wherein like reference numbers generally indicate identical, functionally similar, and/or structurally similar elements.

DETAILED DESCRIPTION OF THE INVENTION

Embodiments of the invention are discussed in detail below. In describing embodiments, specific terminology is employed for the sake of clarity. However, the invention is not intended to be limited to the specific terminology so selected. While specific exemplary embodiments are discussed, it should be understood that this is done for illustration purposes only. A person skilled in the relevant art will recognize that other components and configurations can be used without parting from the spirit and scope of the invention. All references cited herein are incorporated by reference as if each had been individually incorporated.

Figure 4:
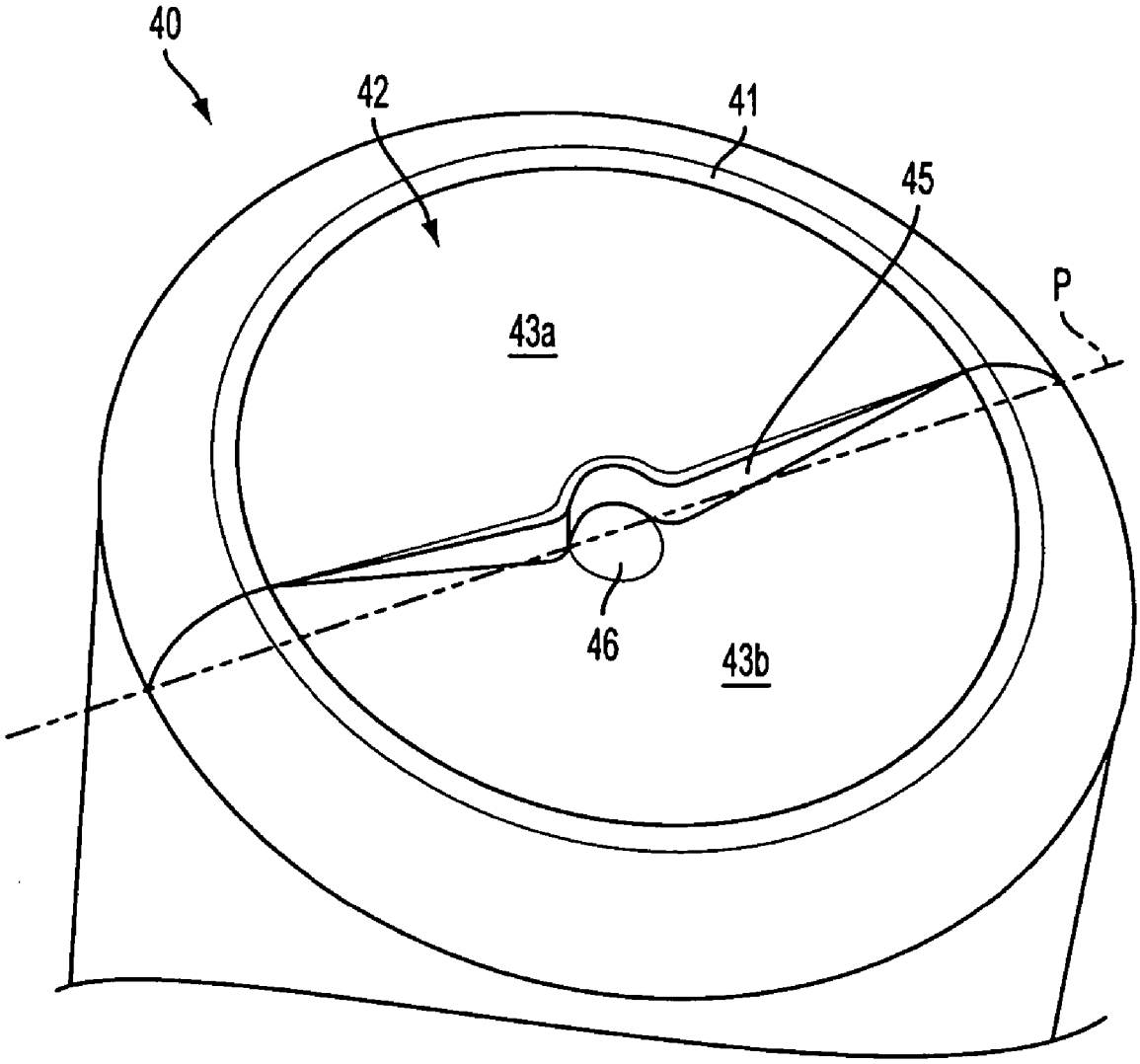
FIG. 4 PRIOR ART
FIG. 4 depicts a prior art base.

Referring to the drawings, FIG. 4 shows a perspective view of a prior art base 40 of a plastic container having an annular bearing surface 41 and an inner portion 42 that is surrounded by annular bearing surface 41. Inner portion 42 has first portion 43*a* and second portion 43*b*. First portion 43*a* and second portion 43*b* are domed surfaces that are separated by offset 45. Offset 45 is a curved surface that curves around excess preform 46 that remains after the blow-molding process. As can be seen in FIG. 4, offset 45 does not extend along parting line P. Offset 45 as shown in FIG. 4 is used to properly orient the container during production of the container. Accordingly, offset 45 is incapable of withstanding increases in internal pressure within the container. Minimal increases in internal pressure of a container having the base 40 as shown in FIG. 4 will cause an outward deformation of inner portion 42.

Figure 5:
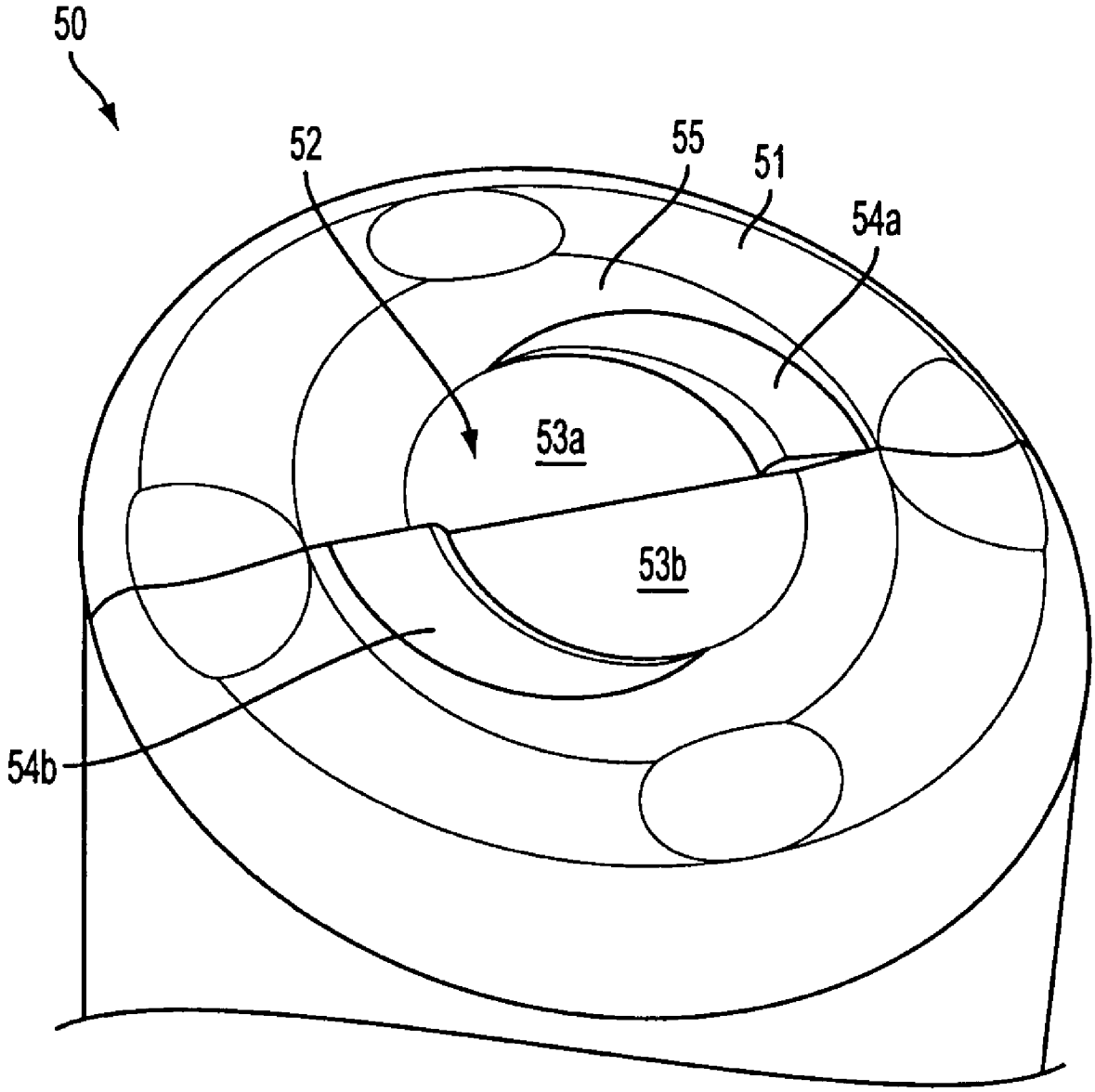
FIG. 5 PRIOR ART
FIG. 5 depicts a prior art base.

FIG. 5 also shows a perspective view of a prior art base 50 of a plastic container having an annular bearing surface 51 and an inner portion 52 that is surrounded by annular bearing surface 51. Inner portion 52 has first portion 53*a* and second portion 53*b* and angled portion 55. Angled portion 55 is flat and angled at approximately 22 degrees. Because angled portion 55 is not curved, base 50 is not capable of withstanding increases in internal pressure within the container. As can be seen in FIG. 5, first portion 53*a* is not offset from second portion 53*b*. Further, first portion 53*a* has lug 54*a* and second portion 53*b* has lug 54*b*. Like the base shown in FIG. 4, lugs 54*a*, 54*b* are used to properly orient the container during production of the container. These design features do not enable the base to be capable of withstanding increases in internal pressure within the container.

Figure 6:
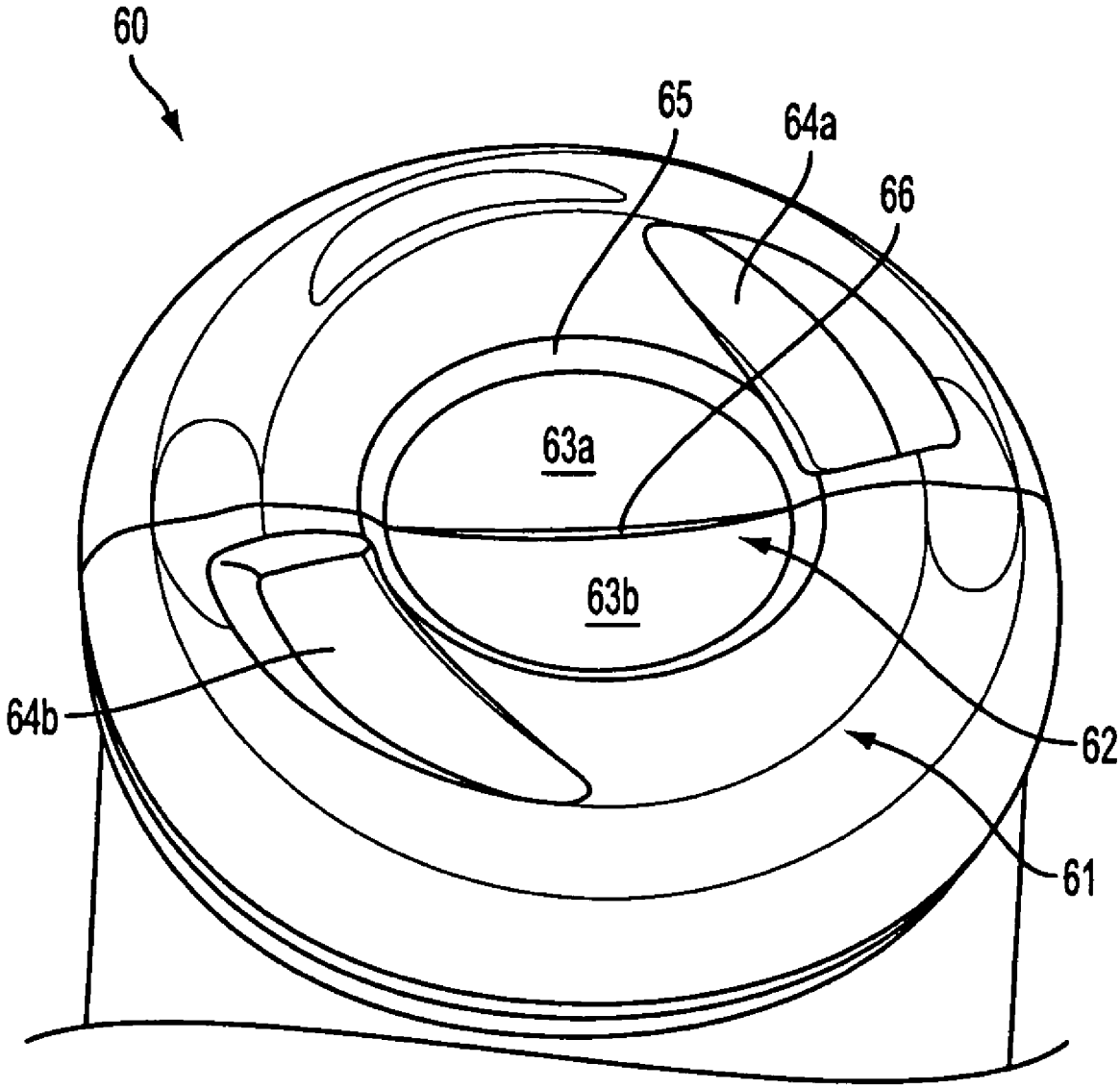
FIG. 6 PRIOR ART
FIG. 6 depicts a prior art base.

FIG. 6 shows a perspective view of a prior art base 60 of a plastic container having an annular bearing surface 61 and an inner portion 62 that is surrounded by annular bearing surface 61. Inner portion 62 has first portion 63*a*, second portion 63*b*, angled portion 65, and offset 66. Further base 60 has lugs 64*a* and 64*b*. Angled portion 65 is flat and angled at an angle of approximately 60 degrees. Offset 66 is a slight offset confined to inner portion 62. Offset 62 does not extend into lugs 64*a*, 64*b*. Lugs 64*a*, 64*b* extend in a direction towards the inside of the container and not in a direction towards annular bearing surface 61. Further, lugs 64*a*, 64*b* extend into annular bearing surface 61. The combination of the above-described features make base 60 less capable of withstanding increases in internal pressure within the container. For example, base 60 may be capable of withstanding increases in internal pressure of only up to 2.5 psi.

Figure 1:
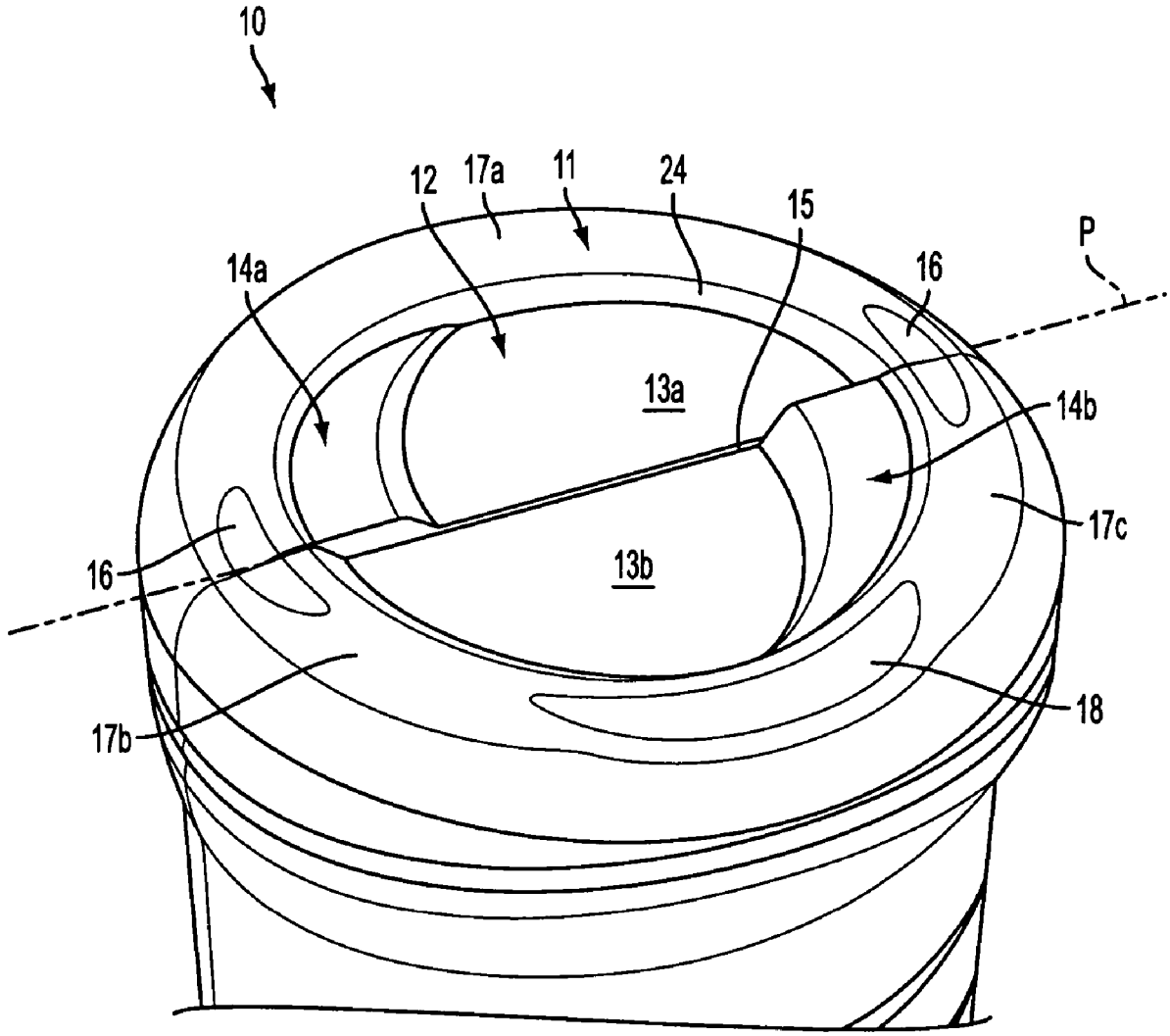
FIG. 1 depicts a perspective view of an exemplary embodiment of a base according to the present invention.

FIG. 1 shows a perspective view of an exemplary embodiment of a base 10 according to the present invention. Base 10 can have annular bearing surface 11 and inner portion 12 that is surrounded by annular bearing surface 11 to form a base that is resistant to outward deformation due to changes internal pressure. These changes in internal pressure of the container can be caused by changes in external pressure as a result of, for example, being transported at a high altitude. In an exemplary embodiment, a base according to the present invention can withstand about 8 psi of internal pressure. More particularly, a base according to the present invention can withstand more than about 3 psi of internal pressure. Exemplary embodiments of the invention can withstand up to about 8 psi of internal pressure.

Annular bearing surface 11 can have a touch point for contact with a horizontal surface (not shown) on which the upright container rests. As shown in FIG. 1, in an exemplary embodiment of the invention, annular bearing surface of base 10 can have three touch points 17*a*-17*c* for contact with the horizontal surface. The presence of three touch points 17*a*-17*c* creates an anti-rock feature as would be apparent to a person having ordinary skill in the art.

Touch points 17*a*-17*c* form a bearing plane (See FIG. 3) that is substantially coplanar with touch points 17*a*-17*c*. Spaced apart from the bearing plane in a substantially perpendicular direction to the bearing plane can be inner portion 12. Inner portion 12 can have first portion 13*a* and second portion 13*b*. Inner portion 12 can also have parting line P that extends along base 10 and defines first portion 13*a* and second portion 13*b*. Parting line P can be formed along the junction of the mold halves during the blow-molding process. In an exemplary embodiment, first portion 13*a* and second portion 13*b* can be substantially flat surfaces on opposite sides of parting line P. However, at least some curvature can be desirable as described further below. Additionally, first portion 13*a* can be offset from second portion 13*b*. This offset can add to the resistance of base 10 to deformation.

Inner portion 12 can include lugs 14*a*, 14*b* that can extend from inner portion 12 in a direction towards the bearing plane. However, to maintain the anti-rock feature discussed above, lugs 14*a*, 14*b* do not intersect the bearing plane. In an exemplary embodiment, lugs 14*a*, 14*b* can be substantially half-crescent-shaped and positioned substantially opposite each other along parting line P. As can be seen in FIG. 1, lug 14*a* can be positioned on first portion 13*a* and lug 14*b* can be positioned on second portion 13*b*.

As discussed above, first portion 13*a* can be offset from second portion 13*b*. In an exemplary embodiment of the invention, where first portion 13*a* is offset from second portion 13*b*, a vertical surface 15 that can extend along parting line P in a direction that is substantially perpendicular to the bearing plane is formed. Vertical surface 15 can couple first portion 13*a* to second portion 13*b* and thus create the offset between first portion 13*a* and second portion 13*b*. In an exemplary embodiment of the invention, vertical surface 15 can be used by container handling equipment, for example, to turn the container to correct rotational orientation for correctly positioning a label.

In an exemplary embodiment of the invention, annular bearing surface 11 can have tunnels 16. As described above, the mold typically contains flash pockets above and below the cavity in the mold to capture the excess of the parison above and below the cavity. Tunnels 16 can provide a channel for the excess parison to travel through as the excess parison is forced into the flash pockets. In an exemplary embodiment, tunnels 16 can be positioned along parting line P. By positioning tunnels 16 along parting line P, the lowest surface on parting line P is moved upward into the container and away from the bearing plane. This movement prevents distortion of the base during flash removal and reduces the likelihood that the base will rock if extra flash remains after trimming. Additionally, base 10 can have depression 18 in annular bearing surface 11. Depression 18 can be positioned between tunnels 16 to form touch points 17*b* and 17*c*, as shown in FIG. 1. In an exemplary embodiment of the invention, tunnels 16 can be depressions that cooperate with depression 18 to form the touch points.

Figure 2:
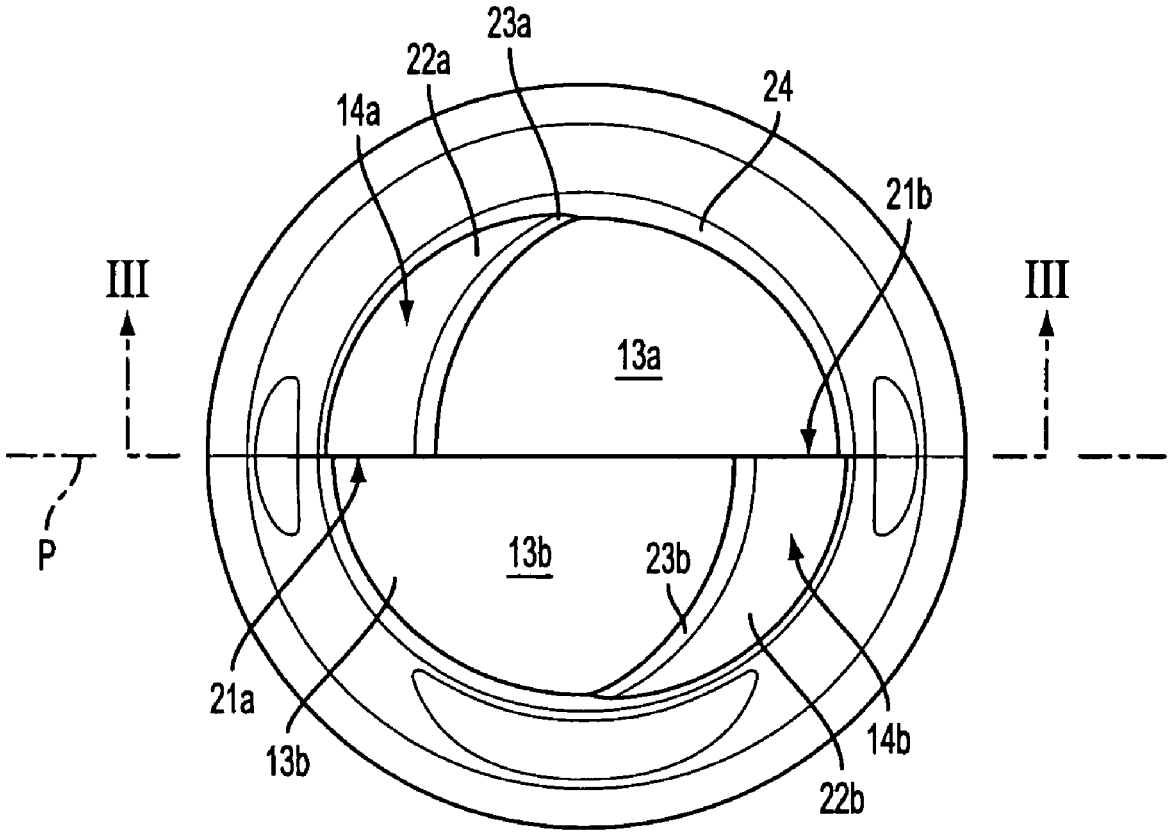
FIG. 2 depicts an exemplary embodiment base according to the present invention.

FIG. 2 shows an exemplary embodiment of base 10. As shown in FIG. 2, lug 14*a* can have wide end 21*a* that extends along parting line P. Similarly, lug 14*b* can have wide end 21*b* that also extends along parting line P. Lug 14*a* can have first surface 22*a* that can merge with inner curvature 24 of base 10. As will be discussed in detail below with reference to FIG. 3, inner curvature 24 can be interposed between annular bearing surface 11 and inner portion 12. Lug 14*b* can also have a first surface 22*b* that can merge with inner curvature 24 of base 10. Additionally, lug 14*a* can have a second surface 23*a* that can merge first surface 22*a* with first portion 13*a*. Similarly, lug 14*b* can have a second surface 23*b* that can merge first surface 22*b* with second portion 13*b*. Lugs 14*a*, 14*b* can extend towards bearing surface 11 up to 65 percent, for example of the total distance h (see FIG. 3) so as not to protrude beyond the bearing surface when base 10 is under maximum pressure.

Figure 3:
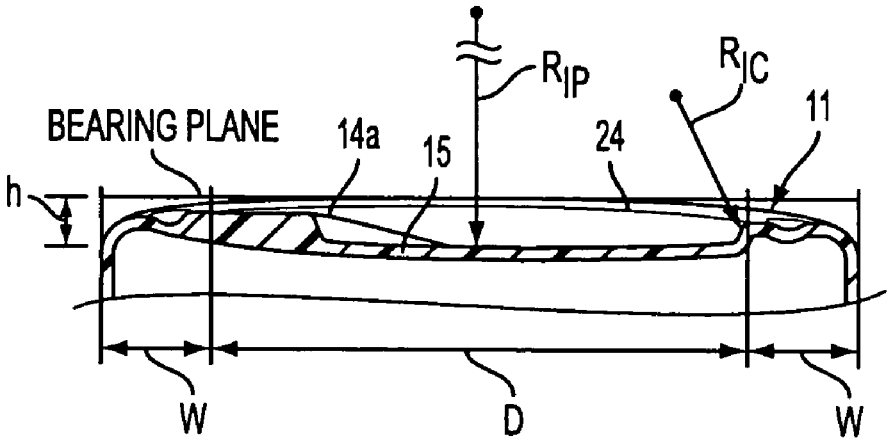
FIG. 3 depicts a cross-sectional view of exemplary embodiment of a base according to the present invention.

FIG. 3 illustrates a cross-sectional view of an exemplary embodiment of a base according to the present invention along line III-III of FIG. 2. FIG. 3 shows annular bearing surface 11, inner curvature 24, lug 14*a*, vertical surface 15 and first portion 13*a* of inner portion 12. As shown in FIG. 3, inner curvature 24 can have a radius of curvature $R_{IC}$ that couples inner curvature 24 to first portion 13*a* and lug 14*a*. Radius of curvature $R_{IC}$ can have a range of 0.090-0.110 inches. In an exemplary embodiment of the invention, radius of curvature $R_{IC}$ can be 0.100 inches. Such a range for radius of curvature $R_{IC}$ can cause a substantially sharp transition between annular bearing surface 11 and inner portion 12, which results in improved resistance to deformation of the base.

As discussed above, inner portion 12 can be spaced apart from the bearing plane. As shown in FIG. 3, inner potion 12 can be spaced apart from bearing plane at a height h. Height h can be measured from the center of the inner portion of the base. In an exemplary embodiment of the invention, height h can be in a range between 0.3186 and 0.3894 inches. In another exemplary embodiment of the invention, height h can be 0.354 inches. Inner portion 12 can be convex and have a radius of curvature $R_{IP}$ that can give inner portion 12 a dome-like appearance. In such an embodiment, the dome may have a large enough $R_{IP}$ to maintain a substantially flat inner portion 12. In an exemplary embodiment of the invention, height h can be between 0.065 and 0.085 times radius of curvature $R_{IP}$. In a further exemplary embodiment, height h can be between 0.07 and 0.08 times radius of curvature $R_{IP}$. In yet a further exemplary embodiment, height h can be 0.075 times the radius of curvature $R_{IP}$. Such ratios of height h to radius of curvature $R_{IP}$ can improve the resistance to deformation of base 10.

FIG. 3 also shows inner portion 12 having a diameter D and annular bearing surface 11 having a width W. In an exemplary embodiment of the invention, diameter D can be 20 and 40 times width W. In a further embodiment of the invention, diameter D can be 25 and 35 times width W. In yet a further exemplary embodiment of the invention, diameter D can be 30 times width W. Such ratios of diameter D to width W can also improve the resistance to deformation of base 10.

The embodiments illustrated and discussed in this specification are intended only to teach those skilled in the art the best way known to the inventors to make and use the invention. Nothing in this specification should be considered as limiting the scope of the present invention. All examples presented are representative and non-limiting. The above-described embodiments of the invention may be modified or varied, without departing from the invention, as appreciated by those skilled in the art in light of the above teachings. It is therefore to be understood that, within the scope of the claims and their equivalents, the invention may be practiced otherwise than as specifically described.

What is claimed is:

1. A container base comprising:

an annular bearing surface defining a bearing plane;

a parting line extending along the base defining first and second portions on opposite sides of the parting line;

an inner portion spaced from the bearing plane and surrounded by the annular bearing surface, first and second lugs extending outwardly from the inner portion towards the bearing plane without intersecting the bearing plane, the first lug defining a first end surface, and the second lug defining a second end surface, wherein the first portion and the second portion are offset from one another to form a common offset wall extending through the inner portion and including the first end surface and the second end surface, wherein the common offset wall comprises a vertical surface extending along the parting line, the vertical surface being substantially perpendicular to the inner portion and having a substantially uniform height between the first end surface and the second end surface, said offset wall providing resistance to distortion upon an increase of internal pressure within the container.

2. The base according to claim 1, wherein the annular bearing surface defines only three touch points for contact with a horizontal surface.

3. The base according to claim 1, wherein the annular bearing surface includes an inner curvature having an inner radius of curvature, the inner curvature merging the annular bearing surface with the inner portion of the base.

4. The base according to claim 3, wherein the annular bearing surface defines only three touch points for contact with a horizontal surface.

5. The base according to claim 1, wherein the first and second lugs are substantially half-crescent-shaped and each has a wide end that extends along the parting line, wherein the first end surface extends along the wide end of the first lug, and the second end surface extends along the wide end of the second lug.

6. The base according to claim 5, wherein the annular bearing surface includes an inner curvature having an inner radius of curvature, the inner curvature merging the annular bearing surface with the inner portion of the base.

7. The base according to claim 6, wherein the first lug includes first and second surfaces, the first surface of the first lug being interposed between the inner curvature and the second surface of the first lug, and the second surface of the first lug merging with the first portion, and the second lug includes first and second surfaces, the first surface of the second lug being interposed between the inner curvature and the second surface of the second lug, and the second surface of the second lug merging with the second portion.

8. The base according to claim 1, wherein the parting line extends substantially through the center of the base.

9. A container base comprising:

an annular bearing portion having a width and defining a bearing surface and a bearing plane;

a parting line extending along the base defining first and second portions on opposite sides of the parting line, an inner portion having a diameter and being spaced from the bearing plane and surrounded by the annular bearing surface, first and second lugs extending outwardly from the inner portion towards the bearing plane without intersecting the bearing plane, the first lug defining a first end surface, and the second lug defining a second end surface, wherein the first portion and the second portion are offset from one another to form a common offset wall extending through the inner portion and including the first end surface and the second end surface, wherein the common offset wall comprises a vertical surface extending along the parting line, the vertical surface being substantially perpendicular to the inner portion and having a substantially uniform height between the first end surface and the second end surface, further wherein the diameter of the inner portion is between 20 and 40 times the width of the annular bearing portion, and the base is capable of withstanding an increase in internal pressure.

10. The container according to claim 9, wherein the inner portion has a radius of curvature and is spaced from the bearing plane in a direction that is substantially perpendicular to the bearing plane at a height that is between 0.065 and 0.085 times the radius of curvature.

11. The container according to claim 10, wherein the diameter of the inner portion is between 25 and 35 times the width of the annular bearing portion.

12. The container according to claim 11, wherein the diameter of the inner portion is 30 times the width of the annular bearing portion.

13. The container according to claim 10, wherein the height is between about 0.070 and 0.080 times the radius of curvature.

14. The container according to claim 13, wherein the height is about 0.075 times the radius of curvature.

15. The base according to claim 9, wherein the annular bearing surface defines only three touch points for contact with a horizontal surface.

16. The base according to claim 9, wherein the first and second lugs are substantially half-crescent-shaped and each has a wide end that extends along the parting line, wherein the first end surface extends along the wide end of the first lug, and the second end surface extends along the wide end of the second lug.

17. The base according to claim 9, wherein the internal pressure is about 8 pounds per square inch (psi).

18. A method of packaging a product, comprising the steps of:

providing a container having a base according to claim 1;

placing the product into the container; and providing an air tight seal over a mouth of the container.

19. A method of packaging a product, comprising the steps of:

providing a container having a base according to claim 9;

placing the product into the container; and providing an air tight seal over a mouth of the container.

20. A container base comprising:

an annular bearing surface defining a bearing plane;

a linear parting line extending along the base defining first and second portions on opposite sides of the parting line;

an inner portion spaced from the bearing plane and surrounded by the annular bearing surface, first and second lugs extending outwardly from the inner portion towards the bearing plane without intersecting the bearing plane, the first lug defining a first end surface, and the second lug defining a second end surface, wherein the first and the second portion are offset from one another to form a common offset wall extending through the inner portion and including the first end surface and the second end surface, wherein the common offset wall comprises a vertical surface extending along the parting line, the vertical surface being substantially perpendicular to the inner portion and having a substantially uniform height between the first end surface and the second end surface.

21. A blow-molded ptastic container base comprising:

an annular bearing surface defining a bearing plane;

a parting line formed along the junctions of mold halves during blow-molding for extending along the base and defining first and second portions on opposite sides of the parting line;

an inner portion spaced from the bearing plane and surrounded by the annular bearing surface, first and second lugs extending outwardly from the inner portion towards the bearing plane without intersecting the bearing plane, the first lug defining a first end surface, and the second lug defining a second end sutface, wherein the first portion and the second portion are offset from one another to form a common offset wall extending through the inner portion and including the first end surface and the second end surface, wherein the common offset wall comprises a vertical surface extending along the parting line, the vertical surface being substantially perpendicular to the inner portion and having a substantially uniform height between the first end surface and the second end surface.

22. A container base comprising:

an annular bearing surface defining a bearing plane;

a parting line extending along the base defining substantially flat first and second portions on opposite sides of the parting line;

an inner portion spaced from the bearing plane and surrounded by the annular bearing surface, first and second lugs extending outwardly from the inner portion towards the bearing plane without intersecting the bearing plane, the first lug defining a first end surface, and the second lug defining a second end surface, wherein the first portion and the second portion are offset from one another to form a common offset wall extending through at least the inner portion and including the first end surface and the second end sutface, wherein the common offset wall comprises a vertical surface extending along the parting line, the vertical surface being substantially perpendicular to the inner portion and having a substantially uniform height between the first end surface and the second end surface.

* * * * *